US007234629B2

(12) United States Patent
Ho

(10) Patent No.: US 7,234,629 B2
(45) Date of Patent: Jun. 26, 2007

(54) PACKAGING BOX

(75) Inventor: Chin-Shu Ho, Hsinchu County (TW)

(73) Assignee: Arcadyan Technology Corporation, Hsinchu (TW)

( * ) Notice: Subject to any disclaimer, the term of this patent is extended or adjusted under 35 U.S.C. 154(b) by 0 days.

(21) Appl. No.: 11/219,703

(22) Filed: Sep. 7, 2005

(65) Prior Publication Data

US 2007/0051786 A1 Mar. 8, 2007

(51) Int. Cl.
*B65D 5/36* (2006.01)

(52) U.S. Cl. ..... 229/117.08; 229/117.07; 229/147; 229/151; 229/178

(58) Field of Classification Search ..... 229/117.01, 229/117.07, 117.08, 147, 151, 178, 942
See application file for complete search history.

(56) References Cited

U.S. PATENT DOCUMENTS

| | | | | | |
|---|---|---|---|---|---|
| 655,680 | A | * | 8/1900 | Bachman | 229/117.01 |
| 938,406 | A | * | 10/1909 | Zell | 229/117.08 |
| 1,054,530 | A | * | 2/1913 | Goodyear | 229/117.07 |
| 1,422,540 | A | * | 7/1922 | Christensen | 229/117.07 |
| 1,563,907 | A | * | 12/1925 | Koff | 229/117.03 |
| 1,738,744 | A | * | 12/1929 | Walter | 229/117.07 |
| 2,210,443 | A | * | 8/1940 | Bergstein | 229/117.07 |
| 2,437,835 | A | * | 3/1948 | Riege et al. | 229/117.07 |
| 2,962,203 | A | * | 11/1960 | Fallert | 229/117.08 |
| 6,126,065 | A | * | 10/2000 | Wee | 229/117.08 |

* cited by examiner

*Primary Examiner*—Gary E. Elkins
(74) *Attorney, Agent, or Firm*—Birch, Stewart, Kolasch & Birch, LLP

(57) ABSTRACT

A packaging box includes a box and a cover. The box and the cover respectively have a plurality of concave folding lines in order for the packaging box to be collapsed and even recycled.

8 Claims, 9 Drawing Sheets

2

2'

PACKAGING BOX

BACKGROUND OF THE INVENTION

1. Field of Invention

The present invention relates to a packaging box, and more particularly, to a packaging box convenient for recycling.

2. Related Art

Many modern electronic devices (such as notebook computers, scanners, computer peripherals, etc) have become indispensable for our daily life. To prevent fragile precise electronic products from being damaged during transportation (e.g. by water, dusts and impacts), they are often put in a packaging box for packaging before shipment. Besides, most of the packaging boxes are made of paper board in view of environmental protection. Therefore, they are both environmentally friendly and protective.

As shown in FIGS. 1 and 2, a conventional packaging box 1 is formed by folding a paper board. The packaging box 1 has four side boards 11, a bottom board 12 and a cover 13. After folding up the side boards 11, one can readily form a packaging box to accommodate an object (such as an electronic product). However, the conventional packaging box 1 is often discarded of without collapsing it, resulting in waste in piling space.

It is thus imperative to provide a packaging box that is convenient for consumers to be recycled.

SUMMARY OF THE INVENTION

In view of the foregoing, the present invention provides a packaging box that can be conveniently recycled.

To achieve the above, a packaging box according to the present invention includes a box and a cover. The box has a bottom board, a first side board, a second side board, a third side board and a fourth side board. The first side board and the second side board are disposed oppositely. The third side board and the fourth side board are disposed oppositely. The first side board has a first concave folding line and a second concave folding line. The second side board has a third concave folding line and a fourth concave folding line. The cover is connected to the first side board and has a fifth concave folding line and a sixth concave folding line. The fifth concave folding line is corresponded to the first concave folding line, and the sixth concave folding line is corresponded to the second concave folding line. The third side board and the fourth side board are folded toward the bottom board. The first side board and the second side board are folded outward along the first concave folding line, the second concave folding line, the third concave folding line and the fourth concave folding line for the box to become flat and form an opening of the box. The cover is folded along the fifth concave folding line and the sixth concave folding line to cover the opening of the box.

As mentioned above, a packaging box according to the present invention can be readily collapsed flat due to a plurality of concave folding lines. Therefore, the packaging box can be conveniently recycled.

BRIEF DESCRIPTION OF THE DRAWINGS

The present invention will become more fully understood from the detailed description given herein below illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
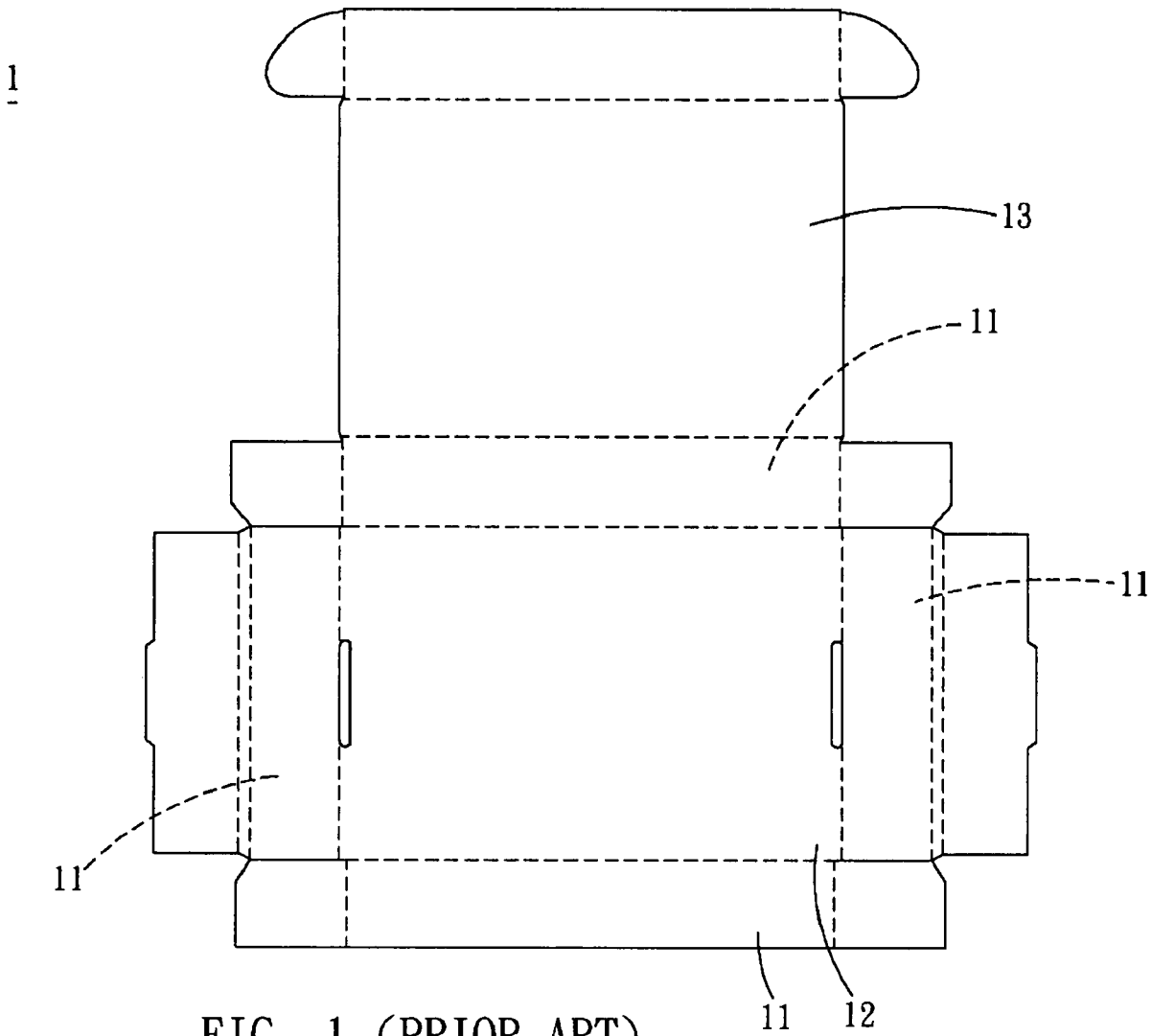
FIG. 1 (PRIOR ART)
FIG. 1 is a schematic expanded view of a conventional packaging box.
Figure 2:
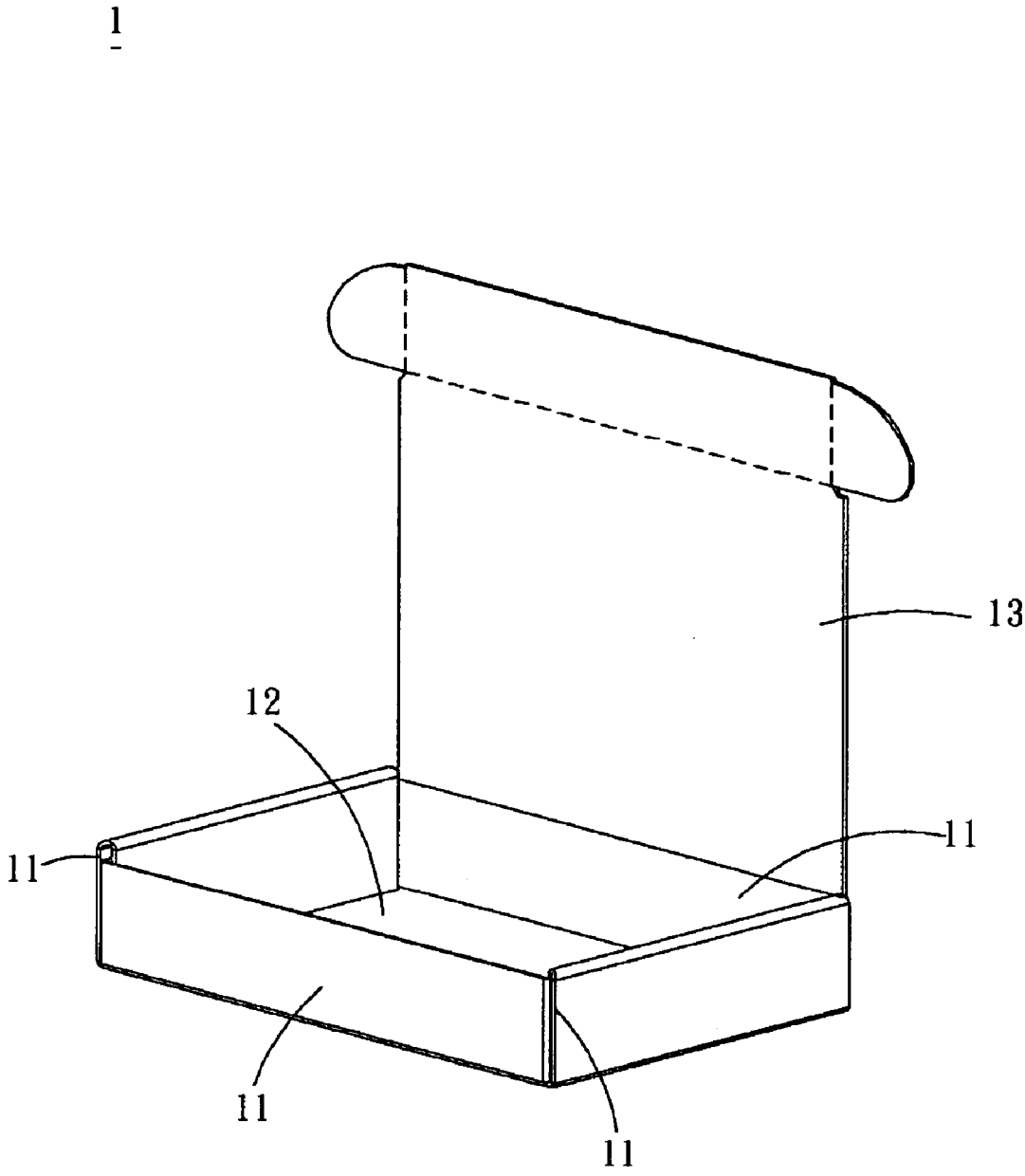
FIG. 2 (PRIOR ART)
FIG. 2 is a three-dimensional view of the conventional packaging box.
Figure 3:
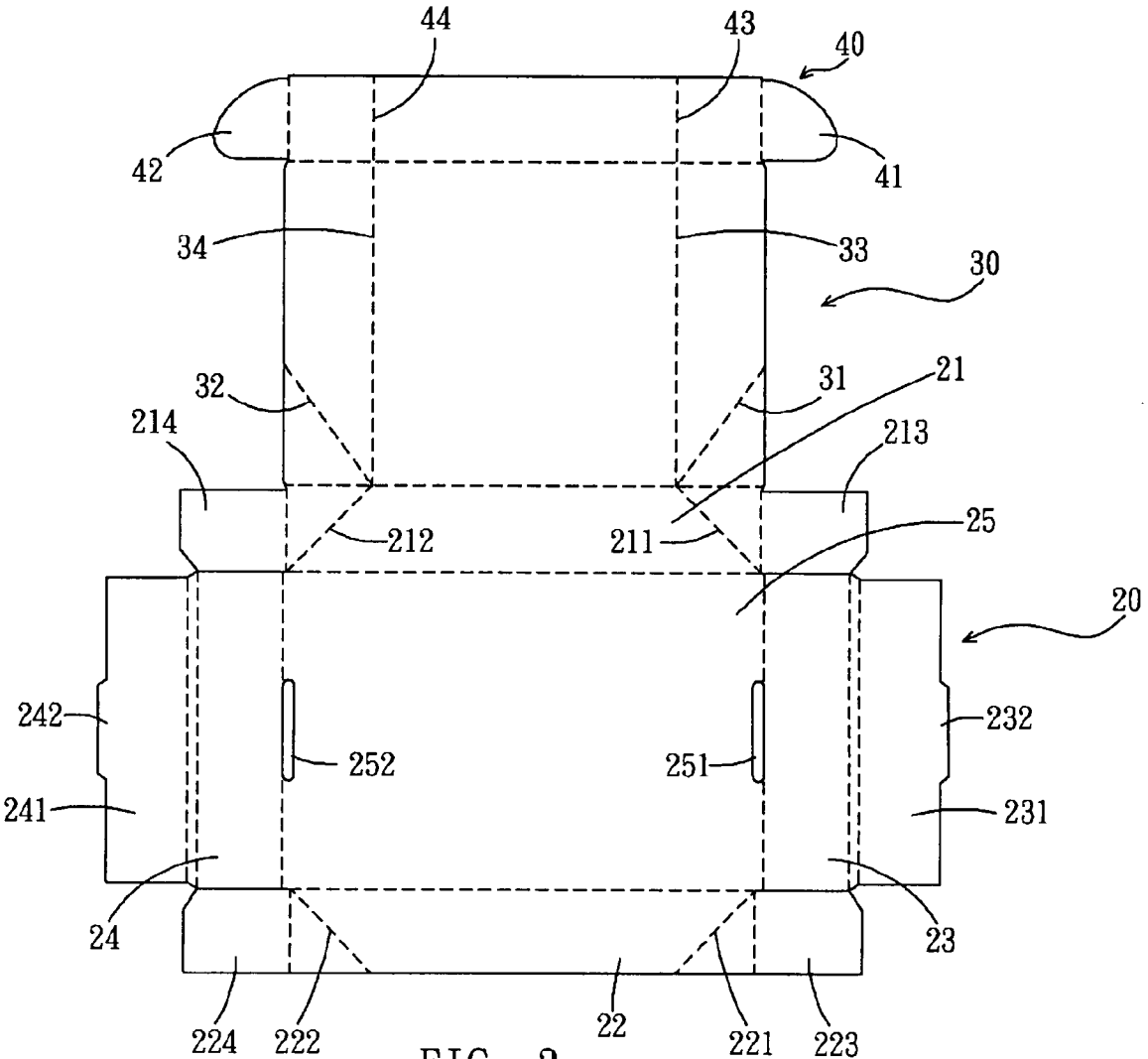
FIG. 3 is a schematic expanded view of a packaging box according to a preferred embodiment of the present invention.

As shown in FIG. 3, a packaging box 2 according to a preferred embodiment of the present invention includes a box 20 and a cover 30. The box 20 has a first side board 21, a second side board 22, a third side board 23, a fourth side board 24 and a bottom board 25.

One edge of the first side board 21, the second side board 22, the third side board 23 and the fourth side board 24 are connected to the border of the bottom board 25. The first side board 21 and the second side board 22 are disposed oppositely, and the third side board 23 and the fourth side board 24 are disposed oppositely.

The first side board 21 has a first concave folding line 211 and a second concave folding line 212. The first concave folding line 211 extends from the connection position of the first side board 21, the third side board 23 and the bottom board 25 toward the center of the first side board 21 and reaches the other edge of the first side board 21. The second concave folding line 212 extends from the connection position of the first side board 21, the fourth side board 24 and the bottom board 25 toward the center of the first side board 21 and reaches the other edge of the first side board 21. The two ends of the first side board 21 respectively extend out a first folding edge 213 and a second folding edge 214.

The second side board 22 has a third concave folding line 221 and a fourth concave folding line 222. The third concave folding line 221 extends from the connection position of the second side board 22, the third side board 23 and the bottom board 25 toward the center of the second side board 22 and reaches the other edge of the second side board 22. The fourth concave folding line 222 extends from the connection position of the second side board 22, the fourth side board 24 and the bottom board 25 toward the center of the second side board 22 and reaches the other edge of the second side board 22. The two ends of the second side board 22 respectively extend out a third folding edge 223 and a fourth folding edge 224.

The third side board 23 extends out a first pressing part 231, which has a first embedding part 232.

The fourth side board 24 extends out a second pressing part 241, which has a second embedding part 242.

The bottom board 25 is disposed with a first embedding hole 251 and a second embedding hole 252. The first embedding hole 251 and the second embedding hole 252 are respectively corresponded to the first embedding part 232 and the second embedding part 242.

In this embodiment, the cover 30 is connected to the other edge of the first side board 21. The cover 30 has a fifth concave folding line 31, a sixth concave folding line 32, a seventh concave folding line 33 and an eighth concave folding line 34. The fifth concave folding line 31 and the first concave folding line 221 are disposed correspondingly, and the sixth concave folding line 32 and the second concave folding line 222 are disposed correspondingly. The seventh concave folding line 33 and the eighth concave folding line 34 respectively extend from the connection position of the cover 30 and the first side board 21 to the outer edge of the cover 30.

Figure 4:
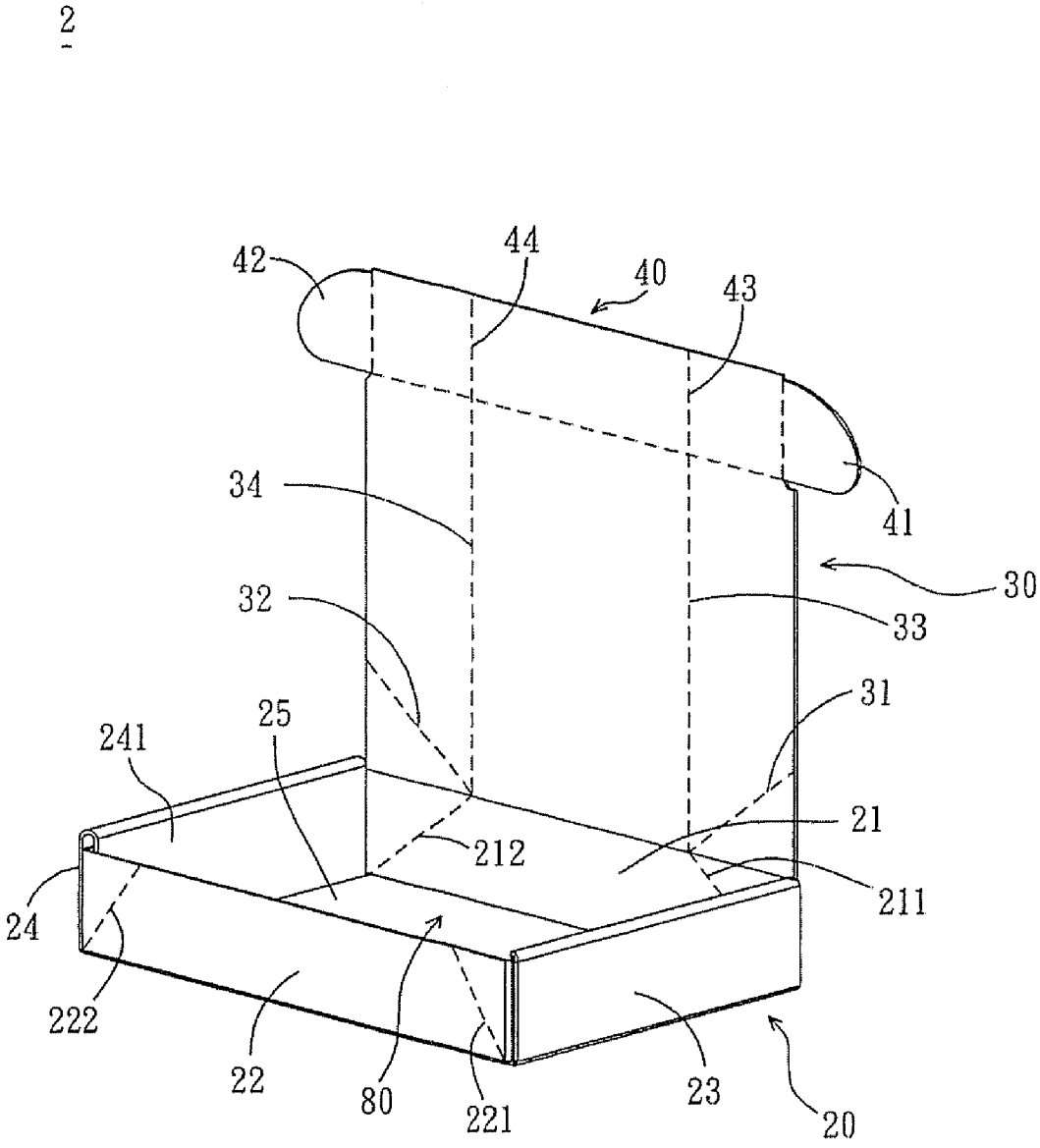
FIG. 4 is a three-dimensional view of the packaging box according to the preferred embodiment of the present invention.

In this embodiment, the packaging box 2 is a three-dimensional structure constructed by the box 20 and the cover 30 made of paper board. When the packaging box 2 is used for packaging, the first side board 21, the second side board 22, the third side board 23 and the fourth side board 24 are first folded up. The first folding edge 213, the second folding edge 214, the third folding edge 223 and the fourth folding edge 224 are then folded. The first pressing part 231 imposes a pressure on the first folding edge 213 and the third folding edge 223, embedding and fixing the first embedding part 232 in the first embedding hole 251. The second pressing part 241 imposes a pressure on the second folding edge 214 and the fourth folding edge 224, embedding and fixing the second embedding part 242 in the second embedding hole 252. Finally, one obtains the packaging box 2 (as shown in FIG. 4) that can be used to accommodate an object (now shown).

Besides, the packaging box 2 in this embodiment may further include a buckle plate 40 connected to the outer rim of the cover 30. Both ends of the buckle plate 40 respectively have a first insertion part 41 and a second insertion part 42. The buckle plate 40 further includes a ninth concave folding line 43 and a tenth concave folding line 44, respectively disposed corresponding to the seventh concave folding line 33 and the eighth concave folding line 34. An opening 80 is formed once the box 20 is assembled, the first insertion part 41 is inserted into the space formed by the first pressing part 231 and the third side board 23. The second insertion part 42 is inserted into the space formed by the second pressing part 241 and the fourth side board 24. The cover 30 is covered and fixed at the opening 80 of the box 20.

Figure 5:
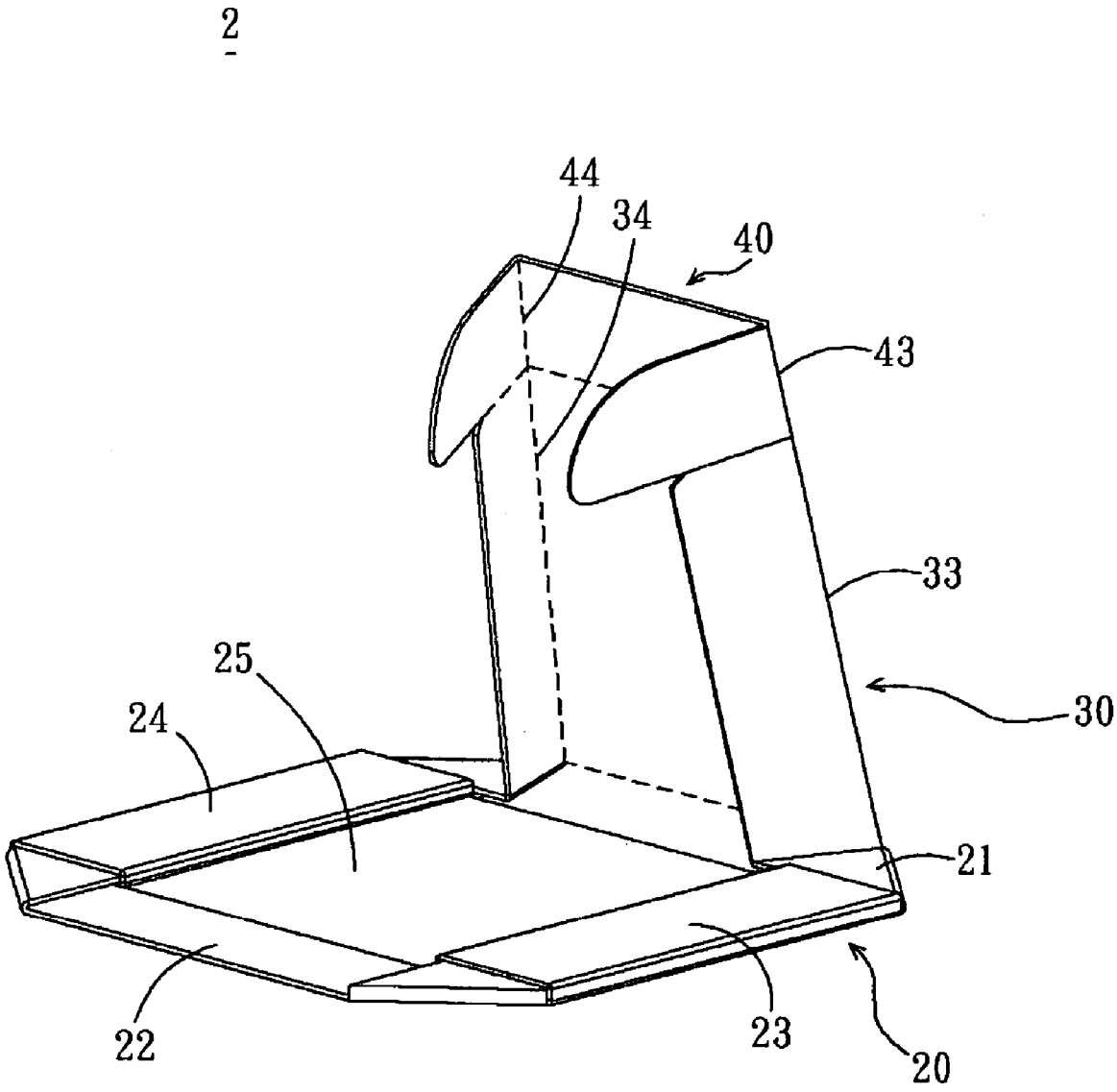
FIGS. 5 and 6 show how to collapse the packaging box according to the preferred embodiment of the present invention.
Figure 6:
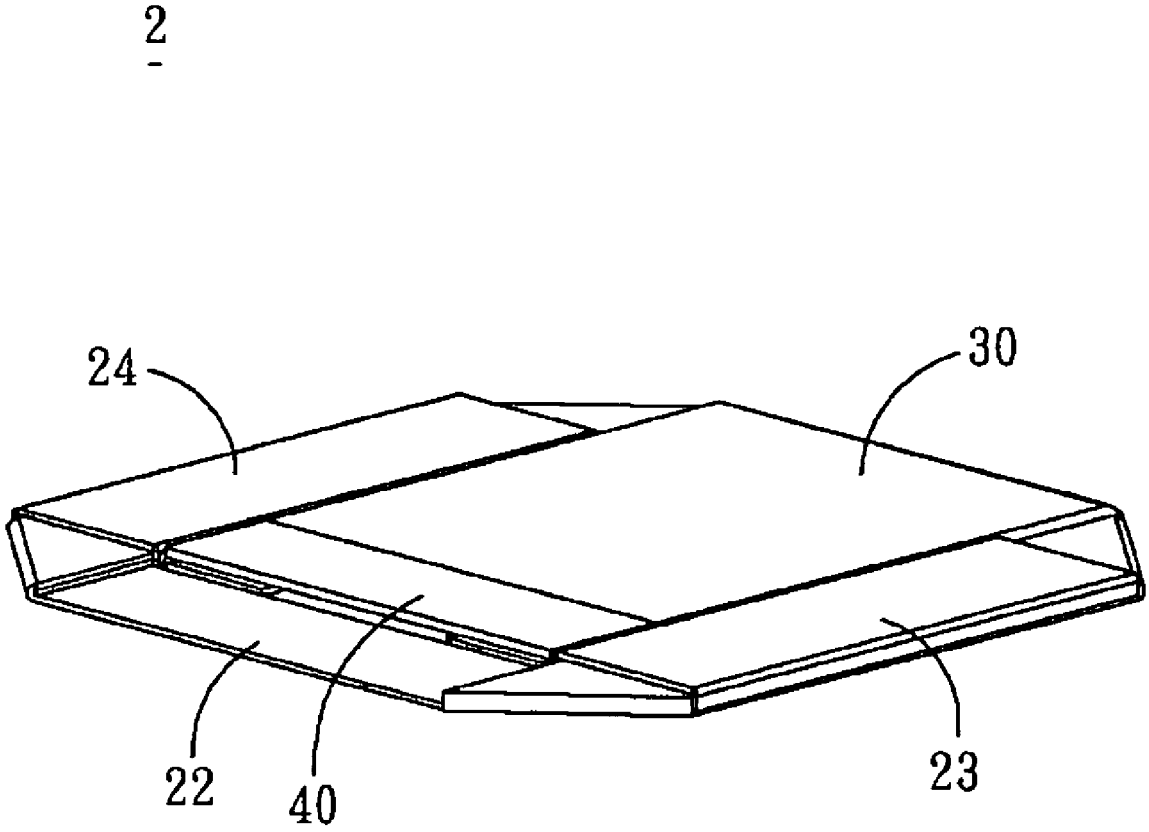

Referring to FIGS. 5 and 6, when the packaging box 2 is recycled, the third side board 23 and the fourth side board 24 are folded toward the bottom board 25. The first side board 21 and the second side board 22 are folded outward along the first concave folding line 211, the second concave folding line 212, the third concave folding line 221 and the fourth concave folding line 222 so that the box 20 becomes flat. The cover 30 and the buckle plate 40 are folded inward along the seventh concave folding line 33, the eighth concave folding line 34; the ninth concave folding line 43, and the tenth concave folding line 44 (as shown in FIG. 5). The cover 30 is folded along the fifth concave folding line 31 and the sixth concave folding line 32 to cover the opening 80 of the box 20. Thus, the packaging box 2 is folded flat (as shown in FIG. 6) for recycling.

Figure 7:
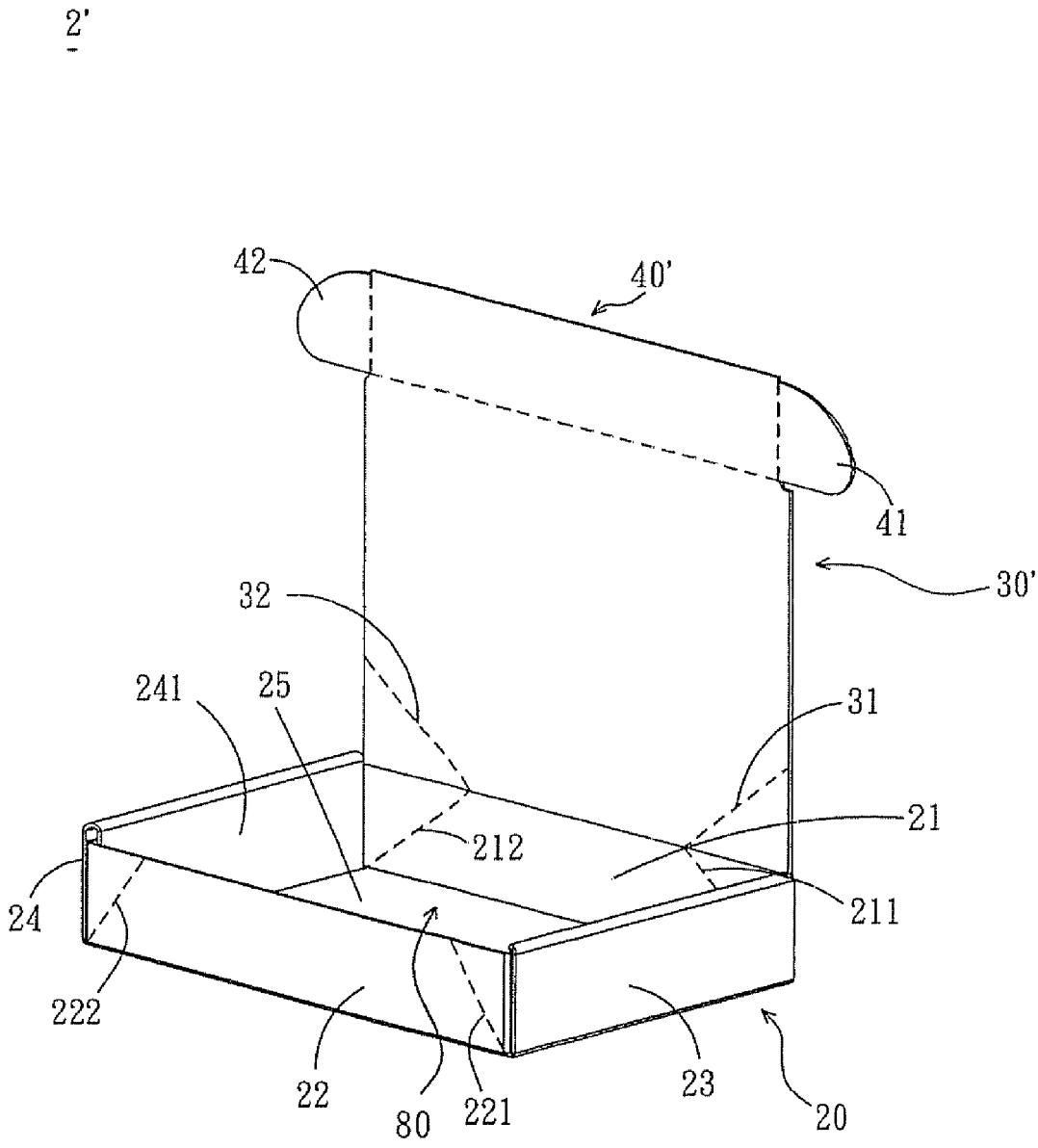
FIG. 7 is a three-dimensional view of a packaging box according to another embodiment of the present invention.

FIG. 7 is a three-dimensional view of a packaging box 2' according to another embodiment of the present invention, wherein the same elements as FIG. 3 are labeled by the same numerals and not further described herein.

The difference between the packaging box 2' in this embodiment and the packaging box 2 in FIG. 3 is that the cover 30' and the buckle plate 40' of this embodiment do not have the seventh concave folding line 33, the eighth concave folding line 34, the ninth concave folding line 43 and the tenth concave folding line 44.

Figure 8:
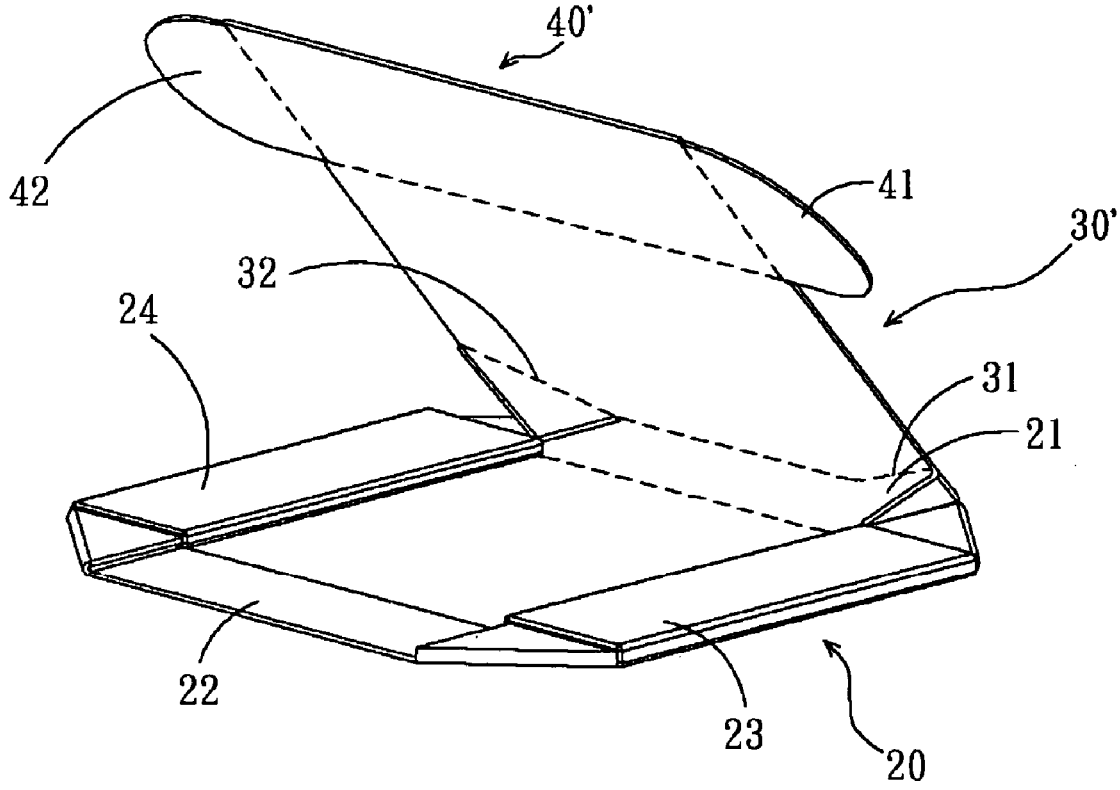
FIGS. 8 and 9 show how to collapse the packaging box according to another embodiment of the present invention.
Figure 9:
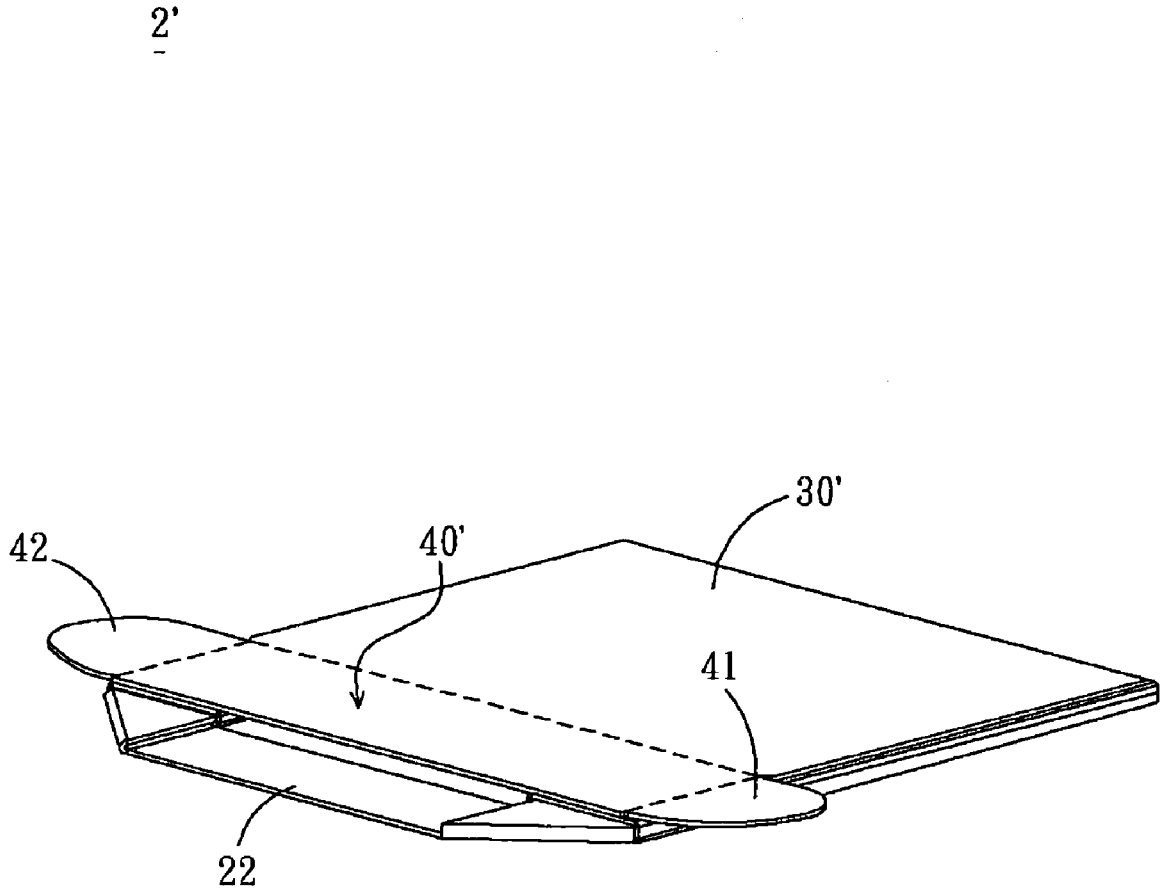

Referring to FIGS. 8 and 9, the third side board 23 and the fourth side board 24 are folded toward the bottom board 25 in order to recycle the packaging box 2'. The first side board 21 and the second side board 22 are folded outward along the first concave folding line 211, the second concave folding line 212, the third concave folding line 221 and the fourth concave folding line 222 so that the box 20 becomes flat (as shown in FIG. 8). The cover 30' is folded along the fifth concave folding line 31 and the sixth concave folding line 32 to cover the opening 80 of the box 20. The packaging box 2' is thus collapsed for recycling (as shown in FIG. 9).

In summary, a packaging box according to the present invention can be readily collapsed flat due to a plurality of concave folding lines. Therefore, the packaging box can be conveniently recycled.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A packaging box, comprising:

a box having a bottom board, a first side board, a second side board, a third side board and a fourth side board, wherein the first side board and the second side board are disposed oppositely, the third side board and the fourth side board are disposed oppositely, the first side board has a first concave folding line and a second concave folding line, and the second side board has a third concave folding line and a fourth concave folding line, both ends of the first side board respectively extend out a first folding edge and a second folding edge, both ends of the second side board respectively extend out a third folding edge and a fourth folding edge, the third side board and the fourth side board respectively extend out a first pressing part and a second pressing part, the first pressing part and the second pressing part respectively have a first embedding part and a second embedding part, the bottom board is disposed with a first embedding hole and a second embedding hole, and after the first folding edge, the second folding edge, the third folding edge and the fourth folding edge are folded, the first pressing part, the second pressing part, the first embedding part, the second embedding part, the first embedding hole and the second embedding hole are used to form the box; and a cover connected to the first side board and having a fifth concave folding line, a sixth concave folding line, a seventh concave folding line and an eighth concave folding line, wherein the fifth concave folding line is disposed corresponding to the first concave folding line, the sixth concave folding line is disposed corresponding to the second concave folding line, the seventh concave folding line and the eighth concave folding line are respectively extended from a connection position of the cover and the first side board outside the cover, the third side board and the fourth side board are folded toward the bottom board, the first side board and the second side board are folded outward along the first concave folding line, the second concave folding line, the third concave folding line and the fourth concave folding line so that the box becomes flat and form an opening of the box, the cover is first folded along the seventh concave folding line and the eighth concave folding line and is then folded along the fifth concave folding line and the sixth concave folding line to cover the opening of the box.

2. The packaging box according to claim 1, wherein each first edge of the first side board, the second side board, the third side board and the fourth side board are respectively connected to the border of the bottom board.

3. The packaging box according to claim 2, wherein the first concave folding line extends from a connection position of the first side board, the third side board and the bottom board and reaches a second edge of the first side board opposite to the first edge of the first side board, the second concave folding line extends from a connection position of the first side board, the fourth side board and the bottom board and reaches the second edge of the first side board, the third concave folding line extends from a connection position of the second side board, the third side board and the bottom board and reaches a second edge of the second side board opposite to the first edge of the second side board, and the fourth concave folding line extends from a connection position of the second side board, the fourth side board and the bottom board and reaches the second edge of the second side board.

4. The packaging box according to claim 1, wherein the first concave folding line and the second concave folding line extend diagonally across of the first side board, respectively.

5. The packaging box according to claim 1, wherein the third concave folding line and the fourth concave folding line extend diagonally across of the second side board, respectively.

6. The packaging box according to claim 1, further comprising a buckle plate, connected to the outer rim of the cover, two ends of the buckle plate respectively have a first insertion part and a second insertion part, when the cover covers the opening of the box, the first insertion part is inserted into the space formed by the first pressing part and the second insertion part is inserted into the space formed by the second pressing part.

7. The packaging box according to claim 6, wherein the buckle plate has a ninth concave folding line and a tenth concave folding line respectively disposed corresponding to the seventh concave folding line and the eighth concave folding line.

8. The packaging box according to claim 1, wherein the box and the cover are made of paper board.

* * * * *